United States Patent [19]

Newman

[11] Patent Number: 4,699,409

[45] Date of Patent: Oct. 13, 1987

[54] METHOD AND MEANS FOR FIXING DOOR FURNITURE

[75] Inventor: Donald J. Newman, Somerville, Australia

[73] Assignee: Ogden Industries Pty. Ltd., Huntingdale, Australia

[21] Appl. No.: 791,409

[22] Filed: Oct. 25, 1985

[30] Foreign Application Priority Data

Oct. 26, 1984 [AU] Australia ..... PG7852/84

[51] Int. Cl.[4] ..... E05C 21/00

[52] U.S. Cl. ..... 292/357; 403/314; 292/DIG. 53

[58] Field of Search ..... 292/357, DIG. 53, DIG. 60; 403/314, 341, 374, 409; 49/503

[56] References Cited

U.S. PATENT DOCUMENTS

| | | | |
|---|---|---|---|
| 297,652 | 4/1884 | Watson | 403/314 |
| 858,439 | 7/1907 | Cantmell | 403/314 |
| 2,013,283 | 9/1935 | Merrill | 403/314 |
| 3,830,030 | 8/1974 | Yoshida | 403/314 |
| 4,228,986 | 10/1980 | Schimmel et al. | 403/314 X |

*Primary Examiner*—Richard E. Moore

*Attorney, Agent, or Firm*—Berman, Aisenberg & Platt

[57] ABSTRACT

Means for attaching a furniture plate to a side surface of a door including an elongate tension member which is secured at one end to the plate and projects laterally from a rear surface of that plate. The opposite end portion of the tension member has an upstanding lip and a camming surface of that lip faces towards the rear surface of the plate. A camming member is located within the door body and is movable along a path parallel to the door side surface, and actuating means which is accessible from the front edge of the door is operable to cause movement of the camming member. When the camming member is moved in one direction along the aforementioned path it engages with the lip camming surface so as to move the tension member in a direction such as to draw the furniture plate rear surface against the door side surface. A single camming member can engage and influence each of two tension members which extend into the door body from respective opposite sides of the door.

15 Claims, 5 Drawing Figures

METHOD AND MEANS FOR FIXING DOOR FURNITURE

This invention relates to the attachment of furniture plates and the like to doors. Such plates are used, by way of example, for the attachment of devices such as knobs, handles and locks to doors. Alternatively, they may be used in relation to such devices for decorative rather than attachment purposes.

Furniture plates of the foregoing kind are usually made of metal and are secured in position by either wood screws or metal thread screws. The latter are generally preferred however because in most cases they provide a more secure form of attachment.

In some cases it is preferred to arrange the fixing screws so that the screw heads are not visible because that allows unauthorized removal of the furniture plate. Vandalism of that kind is quite common in certain types of buildings and consequently preventative steps are necessary such as using concealed screws or so-called one-way screws. The concealed screw technique is usually preferred for aesthetic reasons and because of the difficulty of removing the one-way screws when that is necessary for maintenance or repair purposes.

A commonly adopted concealed screw system involves the use of small screws which are accessible through an edge rather than the front face of the furniture plate and which are rotated by means of an Allen key for example. That system is a deterrent to vandalism, but it is not entirely satisfactory in practice because the screw heads are still accessible to a degree sufficient to permit vandalism. Also, the system is not entirely satisfactory for aesthetic reasons because of the need for recesses in the plate edge or edges to receive the screw heads.

It is an object of the present invention to provide a means for securing furniture plates which overcomes or at least minimizes the foregoing problems. It is a particular object of the invention to provide a concealed fixing system which does not require provision of external recesses on the furniture plate and which cannot be tampered with while the associated door is in a closed position.

According to one aspect of the present invention, there is provided a furniture plate attachment means including, at least one tension member attachable to a furniture plate so as to project laterally outwards therefrom, a camming member arranged for engagement with the tension member and being movable relative thereto, said engagemet being such that said tension member responds to movement of said camming member in one direction by moving in a direction which is transverse to said one direction of the camming member movement and which is away from a said furniture plate to which said tension member is attached, and actuating means operable to cause said camming member movement.

According to a further aspect of the present invention, there is provided in a furniture plate assembly, improved attaching means securing a furniture plate of said assembly to a side surface of a door, said attaching means including, at least one tension member secured to said furniture plate so as to extend outwardly from a rear face of said furniture plate which engages against said door whereby an end portion of said tension member remote from said plate is located within the body of said door, a camming member located in said door body so as to be movable relative thereto along a path extending substantially parallel to said door side surface and being engagable with said tension member end portion, and actuating means accessible from a front edge of said door and being operative to cause said camming member movement, said tension member responding to movement of said camming member in one direction along said path so as to pull said furniture plate rear face against said door side surface.

The essential features of the invention, and further optional features are described in detail in the following passages of the specification which refer to the accompanying drawings. The drawings, however, are merely illustrative of how the invention might be put into effect, so that the specific form and arrangement of the features (whether they be essential or optional features) shown is not to be understood as limiting on the invention.

Figure 1:
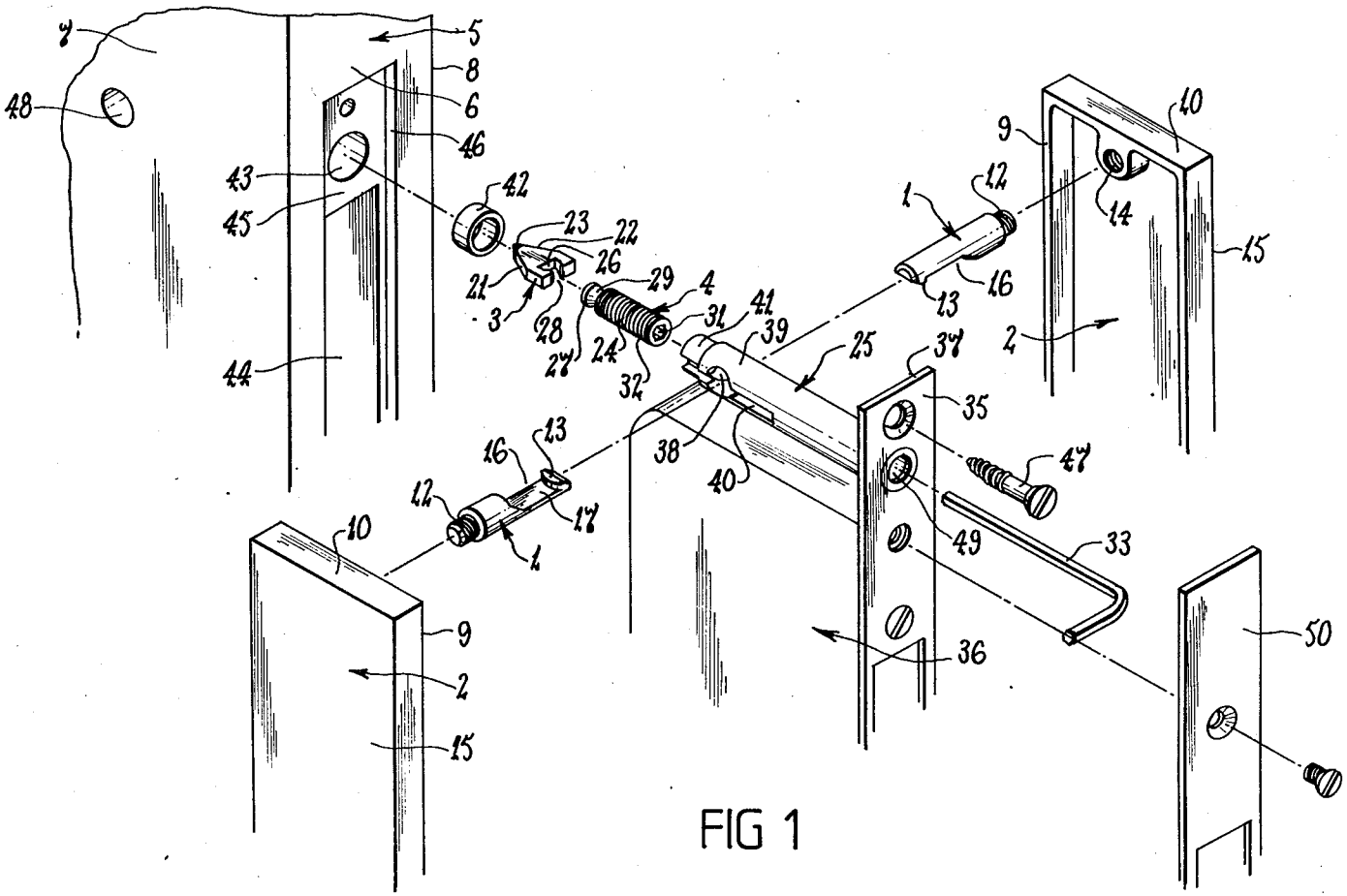
FIG. 1 is an exploded perspective view of one embodiment of the invention.

As shown in FIG. 1, a fixing system according to the invention includes at least one tension member 1 which is attachable to or formed integral with a furniture plate 2, a camming member 3 which is cooperable with the tension member 1 so that movement of the camming member 3 relative to the tension member 1 causes the tension member 1 to move in a particular direction, and actuating means 4 operable to cause the aforementioned relative movement. When the system is installed on a door 5 neither the tension member 1 or the camming member 3 is visible, and as shown it is preferred that the actuating means 4 is accessible only from a front edge 6 of the door 5.

Although the invention is applicable to a single furniture plate situation, it is usual, as shown in FIG. 1, to provide such a plate 2 on both the inner and outer sides 7 and 8 of a door 5 and consequently the invention will be hereinafter described as applied to such a two-plate arrangement.

Figure 3:
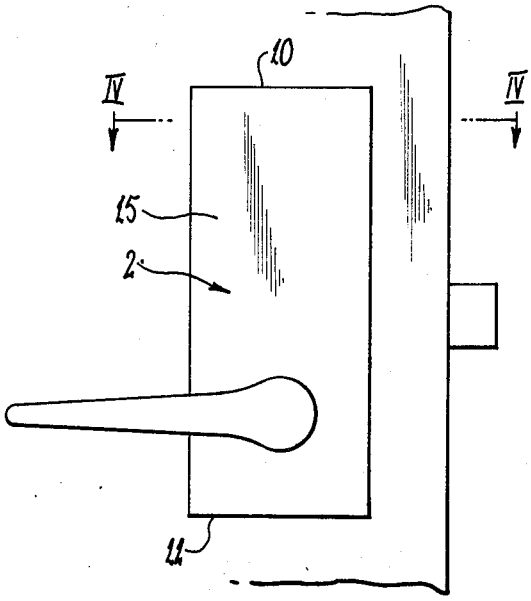
FIG. 3 is an elevation view of a furniture plate attached to a door by means of attaching means as shown in FIG. 1.

According to the example embodiment shown, each of the two furniture plates 2 has at least one tension member 1 projecting outwards from the rear face 9 of the plate 2, which is the innermost face when the plate 2 is mounted on the door 5. Each plate 2 may have a plurality of such tension members 1—e.g., two located adjacent respective opposite edges 10 and 11 of the plate 2 (FIG. 3)—but it will be convenient to hereinafter refer to only one of those members 1. It will be also convenient to describe an arrangement in which the tension members 1 are attached to their respective plates 2 rather than being formed integral therewith.

Each tension member 1 may be in the form of an elongate member as shown in FIG. 1 having connecting means 12 at one end for engagement with the associated furniture plate 2 and a camming abutment 13 at the opposite end portion which is cooperable with the camming member 3. It is generally convenient to form such a tension member 1 from cylindrical stock and, as shown, the connecting means 12 may be an external screw thread which is engagable within a screw threaded bore 14 of the associated plate 2. That bore 14 is provided at the rear face 9 of the plate 2 and is preferably a blind bore arranged so that its existence or location is not detectable from the front face 15 or an edge of the plate 2.

Figure 2:
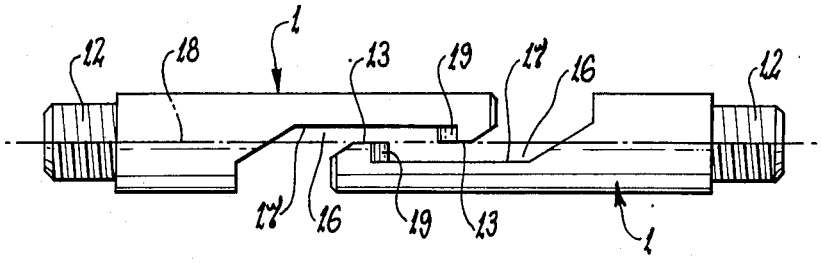
FIG. 2 is an elevation view of two tension members as shown in FIG. 1 which are located in relative positions as adopted in use.

In the preferred arrangement shown, the tension members 1 of the two plates 2 are of such a length that they overlap in the mounted condition of the plates 2, and that overlapping is illustrated by FIG. 2. It is also preferred to arrange the tension members 1 on their respective plates 2 so that they are substantially coaxial in the mounted condition of the plates 2, again as shown by FIG. 2. Such an arrangement requires that the adjacent end portions of the two members 1 are configured so that the overlapping can occur and in the construction shown that is achieved by providing a transversely extending recess 16 in each of the overlapping end portions. In an alternative construction, which is not shown, the outer end portion of one tension member 1 may be reduced in cross sectional size to locate within an axial bore of the other tension member 1.

As shown, the base 17 of each recess 16 is preferably flat and the camming abutment 13 of each tension member 1 is formed by a raised section or lip at the outer extremity of the flat base 17. As best seen in FIG. 2, the flat base 17 is below the axis 18 of the tension member 1 so that the raised lip 13 need not project beyond that axis 18 and thereby possibly obstruct overlapping of the two tension members 1 during mounting of the plates 2. A surface 19 of the raised lip 13 which faces towards the screw threaded end of the tension member 1, forms a camming surface and as shown that surface 19 may be of convex curvature transversely across the tension member 1.

The foregoing arrangement of the tension members 1 is such that when the two furniture plates 2 are located against respective sides 7 and 8 of the door 5, the tension members 1 overlap to an extent such that their respective camming surfaces 19 are in opposed and spaced relationship. That is, as shown in FIG. 2, a space 20 exists between the opposed surfaces 19 and the opposed recess bases 17. The camming member 3 is arranged to locate within the space 20 when the tension members 1 are arranged as shown in FIG. 2, and the camming member 3 thereby coacts with the camming surfaces 19 in a manner such that relative movement of the camming member 3 in one direction transverse to the tension members 1 causes an increase in the degree of overlap of the tension members 1. That is, such movement of the camming member 3 causes each tension member 1 to be drawn axially inwards and that results in the associated furniture plate 2 being pulled firmly against the respective side 7 or 8 of the door 5.

Figure 4:
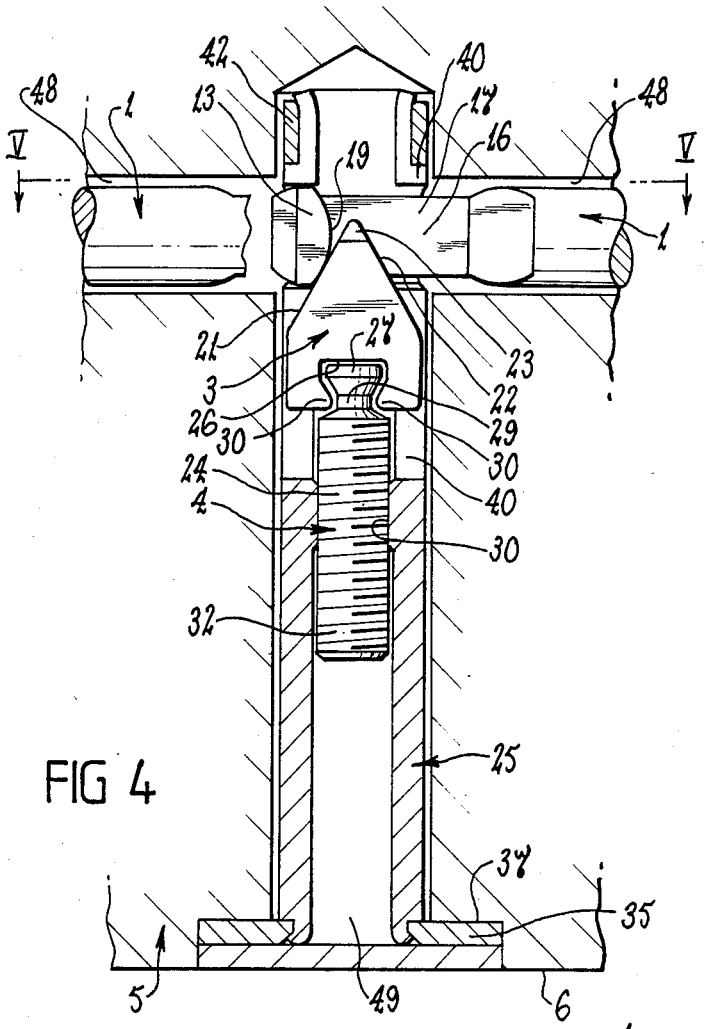
FIG. 4 is an enlarged cross sectional view taken along line IV—IV of FIG. 3.

One form of camming member 3 which is satisfactory for the arrangement described is of wedge-like configuration as best seen in FIGS. 1 and 4. That configuration may be produced by a cone or cone-like arrangement, but it is preferably produced by diverging edges 21 and 22 of a plate-like member as shown. The narrow or leading end 23 of that member 3 is dimensioned to fit between the camming surfaces 19 in a loosely mounted condition of the furniture plates 2, and the divergance of the side edges 21 and 22 is such that there is interference between those edges 21 and 22 and the camming surfaces 19 when the plates 2 are pulled firmly against the door 5.

Actuating means for the camming member 3 preferably includes a driving pin 24 which threadably engages with a fixed member 25 and which also cooperates with the camming member 3 so that rotation of the driving pin 24 controls the relative positions of the camming and tension members 3 and 1. It is possible to make the camming member 3 and the driving pin 24 integral, but in the arrangement shown they are formed separately. It is also preferred that means is provided whereby the driving pin 24 and camming member 3 are retained end to end and held against axial separation.

In the construction shown, the retaining means includes a recess 26 in the trailing end of the camming member 3 and a nose portion 27 of the driving pin 24 which locates in that recess 26. The recess 26 is in the form of a slot which extends through opposite faces of the camming member 3 and which has a mouth 28 of restricted size (FIGS. 1 and 4). A circumferential groove 29 is provided around the nose portion 27 and the arrangement is such that the opposed edges 30 (FIG. 4) of the restricted mouth 28 engage within the groove 29 to resist axial separation of the driving pin 24 and camming member 3. The arrangement is such that the driving pin 24 is able to rotate relative to the camming member 3, but is held against substantial relative axial movement by the cooperation of the camming member edge portions 30 and the nose portion 27.

A hexagonal recess 31 may be provided in the end 32 of the driving pin 24 remote from the nose portion 27 so as to permit driving engagement by an Allen key 33 or the like. It will be appreciated however, that other driving arrangements may be adopted.

The fixed member 25 with which the driving pin 24 cooperates may be of any suitable form. In the construction shown, that fixed member 25 comprises a cylindrical tube which is secured to the door 5 in an appropriate fashion and has an internal thread 34 (FIG. 4) which cooperatively engages with an external thread of the driving pin 24. In the example shown, the tube 25 is secured to the mounting plate 35 of a latch assembly 36 so as to project away from the inner face 37 of that plate 35. A transverse open ended bore 38 (FIG. 1) is provided through an end portion 39 of the tube 25 remote from the mounting plate 35 so as to provide a passage for the tension members 1. That end portion 39 is also separated by a longitudinally extending slot 40 which slidably receives the camming member 3 so as to hold the member 3 against rotation with the driving pin 24. It will be appreciated however, that other means could be adopted for that purpose.

In some circumstances, the tube end portion 39 may tend to spread radially under pressure applied to the sides of the slot 40 by the camming member 3. Such spreading can be prevented by providing the tube 25 with an axial extension 41 which is located beyond the tension members 1 as shown in FIG. 4, and positioning a sleeve 42 over that extension 41.

A latch assembly 36 can be mounted on the door 5 by insertion into a cavity 44 formed in the front edge 6 of the door 5. The latch assembly mounting plate 35 engages against the base 45 of a shallow recess 46 formed in the door edge 6 and is secured to the door 5 by screws 47 or the like. The door cavity 44 could be larger than normal in order to accept the tube 25, but in the preferred arrangement shown, the door cavity 44 is of normal size and a bore 43 is formed in the door edge 6 to receive the tube 25. The driving pin 24 and camming member 3 are connected to the tube 25 before the latch assembly 36 is mounted on the door 5. That is, the pin 24 threadably engages with the tube 25 so that the nose portion 27 is remote from the mounting plate 37 and the camming member 3 is slidably located in the slotted end portion 39 of the tube 25 and arranged so that its leading end 23 faces inwardly of the door edge 6. The camming member 3 is retained in association with the driving pin 24 in the manner described and the position of the pin 24 is such that the camming member 3 does not substantially intrude into the transverse bore 38 of the tube 25.

Figure 5:
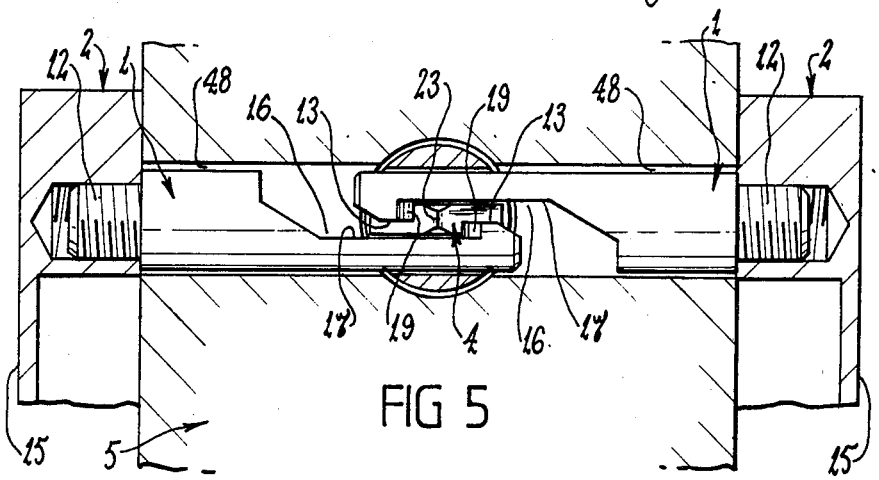
FIG. 5 is a view taken along line V—V of FIG. 4.

The door 5 is drilled or bored to provide aligned passages 48 to receive the tension members 1 of the two furniture plates 2 and those passages 48 are aligned with the transverse bore 38 of the tube 25. The tension members 1 of the two furniture plates 2 are relatively arranged so that their respective recess bases 17 will face towards one another in the mounted condition of the plates 2 (see FIGS. 2 and 5). Each plate is placed over a respective opposite side 7 and 8 of the door 5 so that its respective tension member 1 enters the door passage 48 and passes from there into the transverse bore 38 of the tube 25. When the two furniture plates 2 are engaging the door 5, the two tension members 1 will be overlapped within the transverse bore 38 as shown.

The driving pin 24 can then be rotated by means of the Allen screw 33 inserted into the exposed outer end 49 of the tube 25, and the leading end 23 of the camming member 3 is thereby moved into the space 20 between the opposed camming faces 19 of the two tension members 1 (FIG. 4). Continued movement of the camming member 3 in that direction brings the diverging side edges 21 and 22 of the member 3 into engagement with the camming surfaces 19 so that those surfaces 19 are progressively forced further apart. That is, each tension member 1 is drawn further into the door 5 and as a result the associated furniture plate 2 is pulled firmly against the adjacent door surface 7 or 8.

When the furniture plates 2 have been secured to a sufficient degree, the Allen key 33 is removed and a cover plate 50 may be then secured over the mounting plate 35 so as to hide the open outer end 49 of the tube 25 and perhaps also hide the mounting plate fastening screws 47. Thus, there is no part of the furniture plate fixing system which is visible or accessible while the door 5 is closed. Even when the door 5 is open, that system becomes accessible only after the cover plate 50 is removed.

It will be apparent from the foregoing description that the method and means described provides an effective fixing system for door furniture which is substantially vandal-proof. On the other hand, the system allows the furniture to be removed and replaced with minimum difficulty. Furthermore, the system does not disturb the appearance of the door furniture because no part of the system, including access passages, is exposed in the fully assembled condition of the furniture plates and associated components.

Various alterations, modifications and/or additions may be introduced into the constructions and arrangements of parts previously described without departing from the spirit or ambit of the invention as defined by the appended claims.

Having now described my invention what I claim as new and desire to secure by Letters Patent is:

1. Furniture plate attachment means including, a tension member attached to a furniture plate and projecting laterally therefrom for insertion into the body of a door, a camming member for location within said door to engage with said tension member and being movable relative to said tension member along a path extending transverse to the direction of said lateral projection, and actuating means connected to said camming member so as to be rotatable relative thereto about an axis which extends in the direction of said path, said camming member being responsive to said relative rotation to move along said path, and the engagement between said tension and camming members being such that movement of said camming member in one direction along said path causes said tension member to be drawn into said door in a direction away from said furniture plate.

2. Furniture plate attachment means according to claim 1, wherein there are at least two said tension members, an end portion of each said tension member is arranged to overlap the corresponding end portion of the other, said camming member is engagable with both said tension members, and said transverse direction of movement of each said tension member is opposite to that of the other.

3. Furniture plate attachment means according to claim 1, wherein said tension member is an elongate member having connecting means at one end whereby it is attachable to a said furniture plate, a camming surface is provided at the opposite end portion of said tension member for engagement with said camming member, and said camming surface faces towards said one end.

4. Furniture plate attachment means according to claim 3, wherein said camming surface is of convex curvature between opposite sides of said tension member.

5. Furniture plate attachment means according to claim 3, wherein said camming surface forms one side of a lip section which projects upwardly from a longitudinally extending surface of said tension member, and said lip section does not project upwardly beyond the longitudinal axis of said tension member.

6. Furniture plate attachment means according to claim 1, wherein an opertive portion of said camming member progressively reduces in width in a direction transverse to said one direction, and the minimum width of said operative portion is at an end of said camming member which is the leading end thereof when said camming member is moving said one direction.

7. Furniture plate attachment means according to claim 6, wherein said camming member is a plate-like member, said operative portion is of wedge shape, and a sloping side surface of said operative portion engages with said tension member to cause said tension member movement.

8. Furniture plate attachment means according to claim 7, wherein said camming member is mounted in an end portion of a cylindrical tube so as to be movable relative to the tube in the axial direction thereof while being held against rotation about the axis of said tube.

9. Furniture plate attachment means according to claim 8, wherein said actuating means includes a driving pin having a screw thread which cooperatively engages with an internal thread of said cylindrical tube so that said pin moves in the axial direction of said tube when rotated relative to that tube, and a nose portion which is connected to said camming member so that said camming member follows said axial movement of the pin.

10. In a furniture plate assembly, improved attaching means securing a furniture plate of said assembly to a side surface of a door, said attaching means including, at least one tension member secured to said furniture plate so as to extend outwardly from a rear face of said furniture plate which engages against said door whereby an end portion of said tension member remote from said plate is located within the body of said door, a camming member located in said door body for movement relative thereto along a path extending substantially parallel to said door side surface and being engagable with said tension member end portion, and actuating means accessible from a front edge of said door and being operative to cause said movement of said camming member, said tension member responding to movement of said camming member in one direction along said path so as to pull said furniture plate rear face against said door side surface.

11. Attaching means according to claim 10, wherein there are at least two said tension members and each is secured to a respective said furniture plate, each of said furniture plates is at a respective one of two opposite side surfaces of said door, and said camming member engages the said end portion of each said tension member.

12. Attaching means according to claim 11, wherein said two end portions overlap and at least part of said camming member is located between those end portions.

13. Attaching means according to claim 10, wherein said tension member is removably secured to said furniture plate and is completely hidden from view by the furniture plate when that plate engages against said door side surface.

14. Attaching means according to claim 10, wherein said actuating means is connected to a latch assembly mounted within a cavity formed in said door edge and is totally contained within said door.

15. Attaching means according to claim 10, wherein the attaching means is independent of means for opening and closing the door.

* * * * *